US005419269A

United States Patent [19]

Clerk

[11] Patent Number: 5,419,269

[45] Date of Patent: May 30, 1995

[54] SAILING BOAT

[76] Inventor: Ernest J. Clerk, 18 South Avenue, Kingston 10, Jamaica

[21] Appl. No.: 5,107

[22] Filed: Jan. 15, 1993

[30] Foreign Application Priority Data

Jan. 15, 1992 [GB] United Kingdom ..... 9200767

[51] Int. Cl.[6] ..... B63H 9/06

[52] U.S. Cl. ..... 114/39.1; 114/102; 114/111

[58] Field of Search ..... 114/39.2, 39.1, 102, 114/103, 105, 108, 109, 110, 111, 112, 113, 204

[56] References Cited

U.S. PATENT DOCUMENTS

| | | | |
|---|---|---|---|
| 1,856,803 | 5/1932 | Blackman | 114/102 |
| 3,173,395 | 3/1965 | Laurent | 114/102 |
| 3,251,329 | 5/1966 | Smith | 114/102 |
| 3,345,969 | 10/1967 | Purvis | 114/102 |
| 4,013,031 | 3/1977 | Viviano | 114/102 |
| 4,719,869 | 1/1988 | Harken et al. | 114/102 |
| 5,048,442 | 9/1991 | Hackney | 114/102 |

FOREIGN PATENT DOCUMENTS 2128153 9/1983 United Kingdom .

OTHER PUBLICATIONS

U.K. Search Report "The Sailing Yacht" by Juan Baader 2nd Edition published by Granada Publishing Ltd. 1979, pp. 8,31 and 8,32.

*Popular Science,* Nov. 1991, p. 85.

Brochure from Hinterhoeller Yachts for Nonsuch.

*Primary Examiner*—David A. Bucci

*Assistant Examiner*—Thomas J. Brahan

*Attorney, Agent, or Firm*—Fisher & Associates

[57] ABSTRACT

The present invention provides a sail boat having a single main sail having a corner between a taut luff edge and a foot edge. A snatch lock is provided at the corner for securing the corner to the bow of the boat, e.g. to U-bolt. When it is required to change tack, the corner is unhooked from the bolt, passed around the rear of the mast (16) and resecured to the bolt (46), in other words, the sail then lies on the other side of the mast and so the boat can sail away on the opposite tack.

8 Claims, 3 Drawing Sheets

SAILING BOAT

The present invention relates to a sailing boat having a single main sail hoistable on a mast.

A standard single-masted sailing boat has a main sail of generally triangular shape, the leading edge of which is secured to the mast and the foot of which is held by a swinging boom. Such a boat also has a jib (or other equivalent sail) located forward of, and hoistable on, the mast. It is known that a sailing boat can be sailed solely by means of the main sail and indeed some boats only have a sail of the above type. One of the disadvantages of sailing a boat solely using a main sail is that the mast disturbs the flow of air over the luff (or leading edge) of the sail which considerably reduces the effect of the said in propelling the boat. To counteract this problem, it is possible to make the mast thinner but this requires the mast to be extensively guyed by wire or rods, which create drag, thereby reducing the beneficial effects of having a narrower mast.

The present invention is intended to overcome the above problems by providing a sailing boat with a single sail (a main sail) the luff edge of which is located forward of the mast.

According to the present invention, there is provided a sailing boat comprising:

a bow end, a stern, a mast, a single main sail hoistable on the mast, the sail having a taut luff edge located forward of the mast, a foot edge at the bottom of the sail and a corner between the foot edge and the luff edge (hereinafter referred to as the "foot/luff corner"), means for releasably securing the foot/luff corner to the bow end of the boat in a position forward of the mast, the arrangement being such that the sail can be located on the starboard side of the mast or on the port side of the mast and can be moved between these two sides.

When the boat is on the starboard tack, the sail should be located on the port side of the boat and when the boat is on a port tack, the sail should be located on the starboard side of the mast. Thus, in order to change tack, it is necessary to release the foot/luff corner of the sail from the securing means and pass the sail around the mast and secure it once agin to the securing means. In order to prevent the sail flying away while moving the sail around the mast, it is preferred to provide means connecting the foot/luff corner (or some adjacent part of the sail) to the boat; this connecting means can be a chain, wire or rope secured at one end to the sail and at the other end to a guide that extends around the mast. This guide may either be a channel sunk into the deck of the boat or a yoke or collar secured to the deck of the boat.

Figure 1:
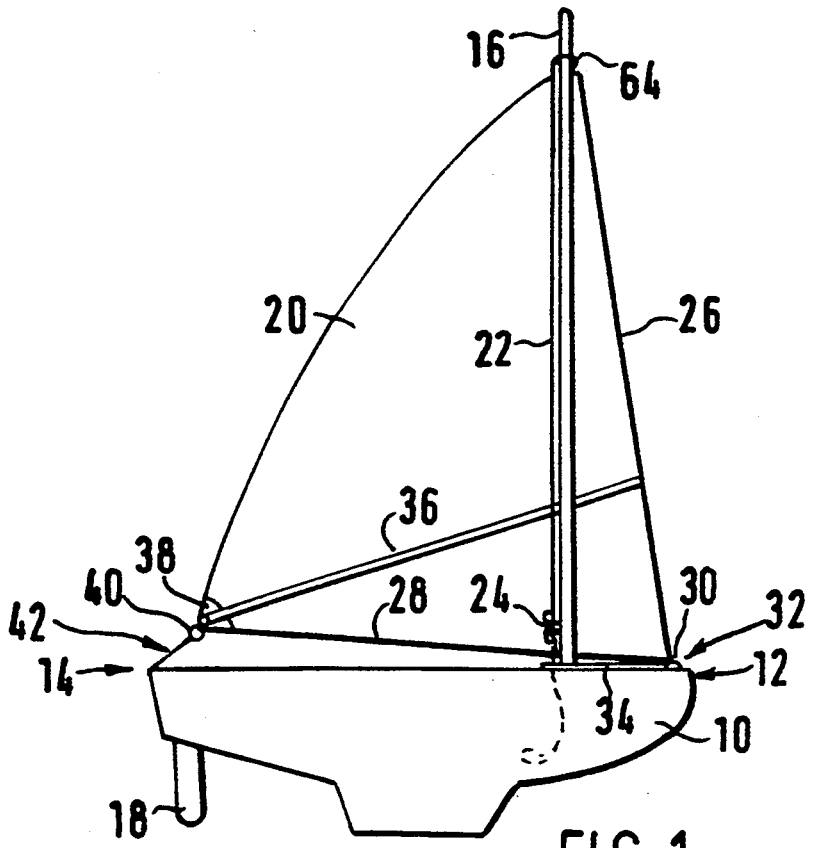
Figure 2:
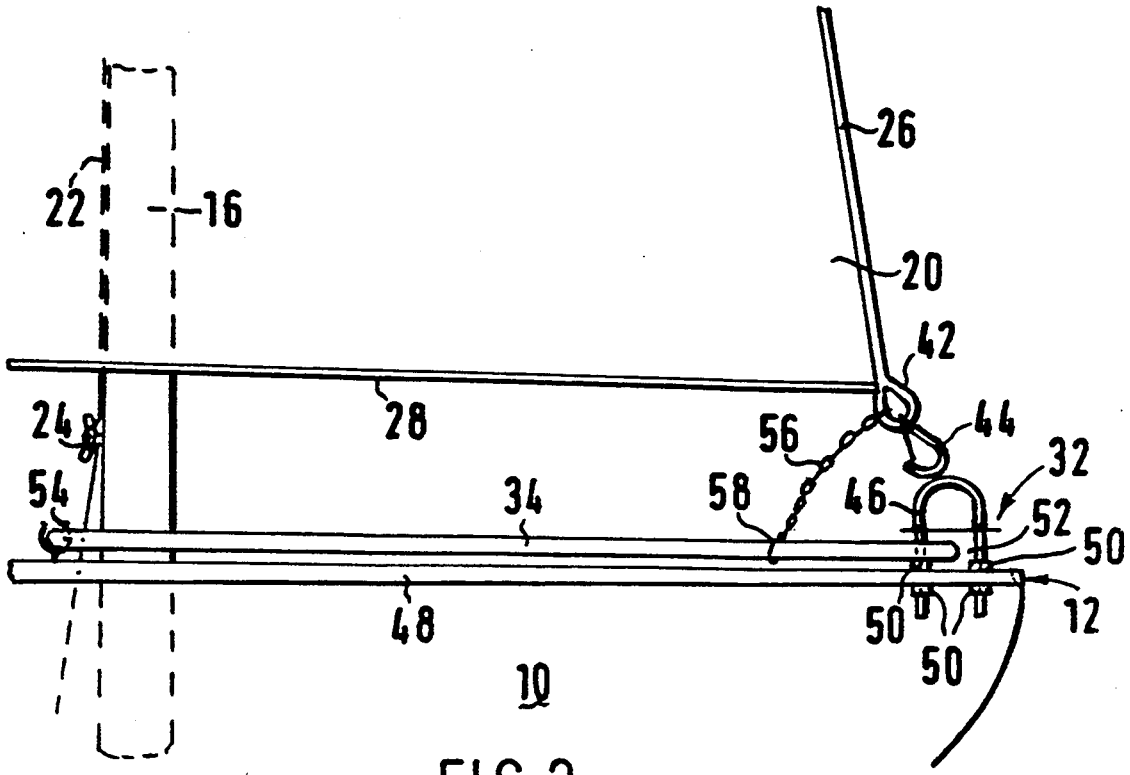
Figure 3:
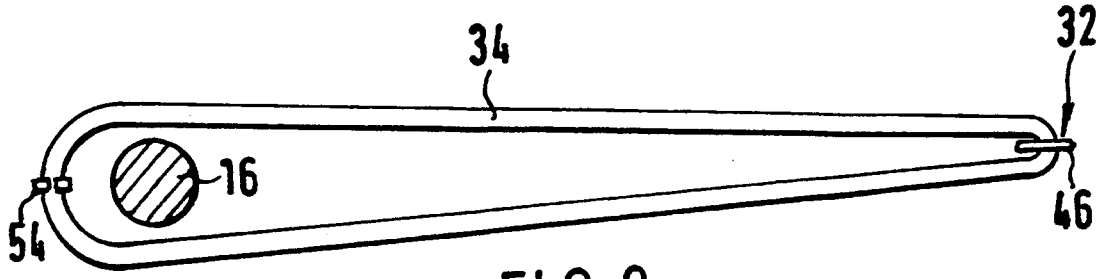
Figure 4:
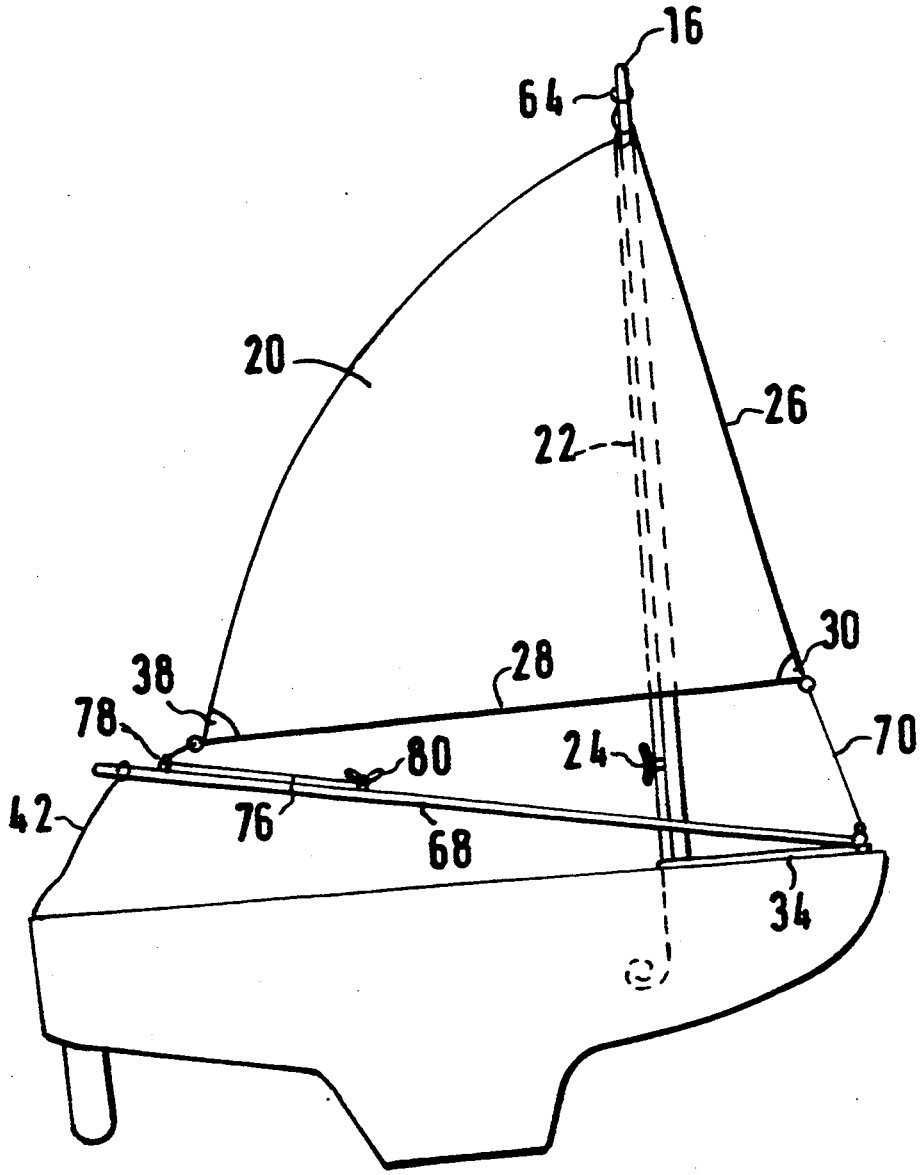
Figure 5:
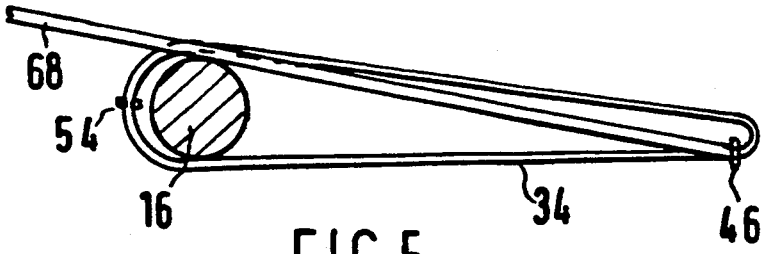
Figure 6:
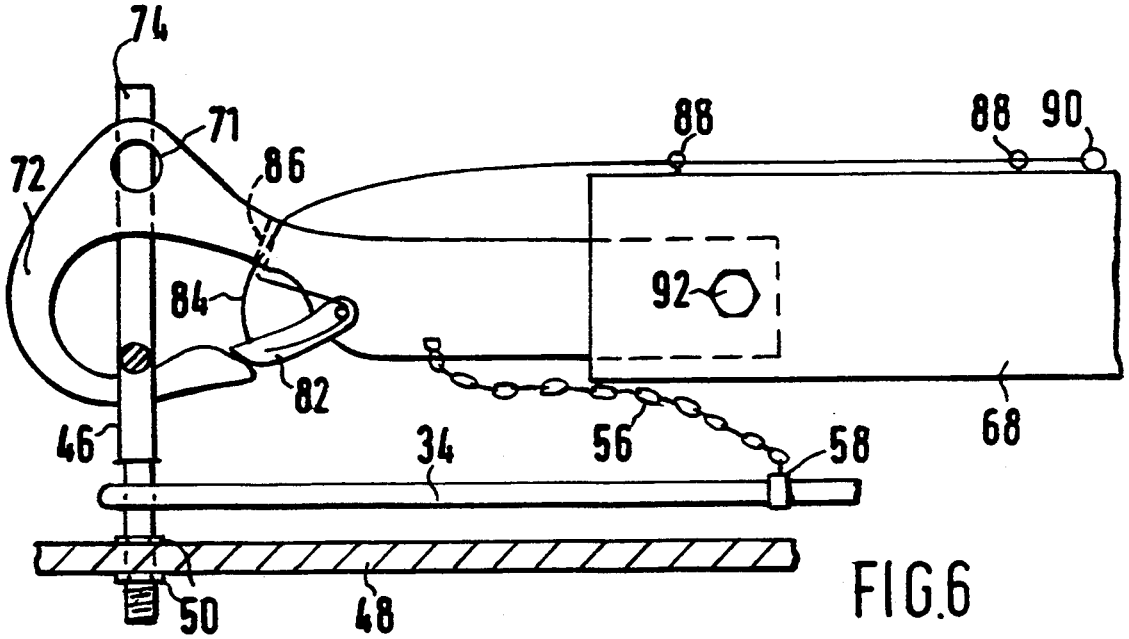
Figure 7:
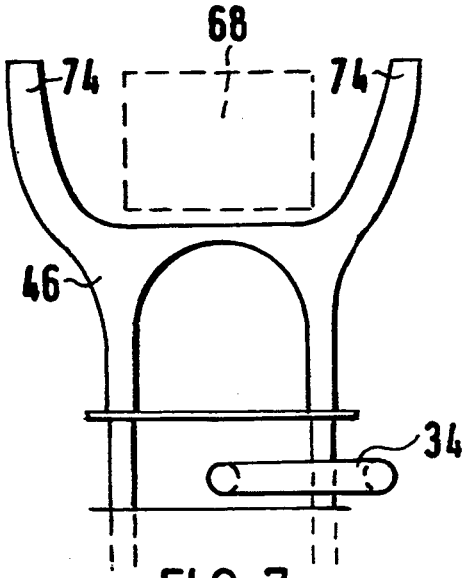
Figure 8:
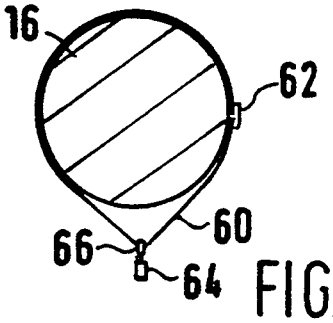
Figure 9:
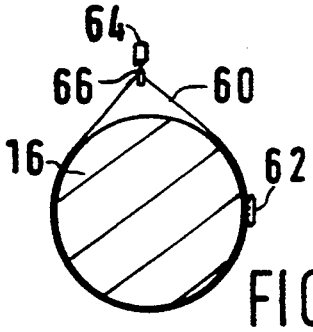

The invention will be described in further detail, by way of example only, with reference to the accompanying drawings, in which:

FIG. 1 is a general view of the starboard side of a boat according to the present invention, FIG. 2 is a detail of the bow section of the boat of FIG. 1, FIG. 3 is a detailed view of the yoke at the bow of the boat of FIGS. 1 and 2, FIG. 4 is a general view of the starboard side of a second boat according to the present invention, FIG. 5 is a plan view of the yoke located at the bow of the boat shown in FIG. 4, FIG. 6 is a detailed side view of the releasable securing means at the bow of the boat shown in FIG. 4, FIG. 7 is a front view of a bracket shown in FIG. 6, and FIGS. 8 and 9 are sectional views taken at the top of the masts of the boats of FIGS. 1 and 4.

Referring initially to FIGS. 1 to 3, there is shown a boat having a hull 10 with a bow end 12 and a stern end 14. The boat has an unstayed mast 16 secured to the hull and a rudder 18. A single sail 20 can be hoisted up the mast by means of a rope 22 and the sail can be kept in its hoisted position by securing the rope 22 by means of a cleat 24 secured to the mast. The sail 20 has a leading edge (or luff edge) 26, a foot edge 28 and a foot/luff corner 30 between these two edges; the foot/luff corner 30 is secured to a bracket 32 at the bow of the boat. A yoke or guide 34 extends in a closed loop from the bracket 32 around the mast 16 (see FIG. 3). The sail has a batten 36 located in a batten pocket of the sail extending from the luff edge 26 to the clew 38 of the sail; the batten keeps the sail extended even when changing tack. An eye 40, is secured in the clew and a sheet 42 attached to the eye 40 secures the sail to the boat. The sheet can be controlled by the helmsman to set the sail at a desired angle.

The arrangement at the bow of the boat is shown in further detail in FIG. 2 but FIG. 2 differs from FIG. 1 in that it shows the sail located on the starboard side of the boat whereas FIG. 1 shows the sail on the port side of the boat. As can be seen in FIG. 2, the luff edge 26 and the foot edge 28 are roped to wire or normal rope so that these edges can be held taut. The end of the rope of the luff edge 26 at the peak of the sail is secured to rope 22 to raise and lower the sail. A cringle (or eye) 42 is made at the foot/luff corner and a snatch-lock 44 is attached to the cringle. The bow end 12 of the boat has a U-shaped bolt 46 that passes through the boat deck 48 and is secured by nuts 50. The yoke 34 extends through a bottom part 52 of the bolt 46 which secures the fore end of the yoke whilst the aft end of the yoke is held in a spring-clip 54. The cringle 42 is connected to the yoke by a chain 56 the lower end of which has a swivelled snatch lock 58 that is slidable on the yoke 34. The length of the chain 56 is sufficient to allow the sail 20 considerable play and should not restrain the movement of the sail 20 except when changing tack (as will be described below).

The boat shown in FIGS. 1 to 3 can be sailed by two people, one being located in the stern of the boat and acting as a helmsman and the other being located at the bow end of the boat. The helmsman controls the rudder 18 and holds the rope 42 and is responsible for steering the boat and setting the angle of the sail while the bowman is responsible for raising and lowering the sail 20 and for moving the sail around the mast when changing tack. In order to commence sailing, the bowman raises the sail by means of the rope 22 which he secures by cleat 24 when the sail is fully raised. At this stage, the swivelled snatch-lock 44 is engaged on the U-bolt 46 to hold the luff edge 26 of the sail taut (in FIG. 2, the snatch-lock is shown detached from the bolt 46). The sail will then fill with wind and the boat will move off on, say a port tack. When ready to go about onto the opposit tack, the bowman will loosen the tension in the luff rope by lowering the sail slightly by means of rope 22. The bowman will then free the snatch-lock 44 from the U-bolt 46 and move the sail around the aft section of the mast 16 and secure the snatch-bolt 44 once more to the bolt 46; by this operation, the sail is moved to the other side of the mast 16. In the meantime, the helmsman will have moved the rudder and the boat will go off on the opposite (starboard) tack. The bowman will then make taut the luff rope 26 using rope 22.

As the luff edge 26 of the sail is not attached to the mast 16, the full effect of the wind at this edge and over the sail is obtained.

The object of the chain 56 and the yoke 34 is to prevent the sail being wrenched out of the bowman's hand while he is passing it around the mast 16. The swivel on snatch-lock 58 prevents the snatch-lock from binding on the yoke while the sail is being moved. In order to allow the snatch-lock 58 to pass completely around the aft section of the mast 16, the yoke must be removed from the spring-clip 54 and it can be re-inserted into the spring-clip once the snatch-lock 58 has passed.

Instead of looped yoke 34, it is possible to provide a track in deck 48 and a bogey can be freely moveable within the track and can be attached to chain 56 by swivel joint. Alternatively, the yoke 34 could have a track formed in it (in a way similar to a curtain) and a bogey can run on the track, which bogey can be secured via a swivel joint to chain 56.

It will be appreciated that rope 22 passes through a pulley 64 at the top of the mast 16 in order to raise and lower the sail. If the pulley 64 were rigidly fixed to the mast, the action of the sail when the boat is on one tack would tend to twist the mast in one direction while, when the boat is on the opposite tack, the mast would be twisted in the opposite direction. In order to eliminate this twisting force on the mast, the pulley 64 is not secured rigidly to the mast but rather is secured to a loop of wire rope or cable 60 around the top of the mast and the pulley 64 slides on this wire loop by means of a swivel joint connected to the pulley 64. This arrangement is shown in FIGS. 8 and 9 which shows a loop of cable 60 encircling the mast 16 and being secured thereto by a clamp 62 at the part of the mast facing the bow of the boat. Pulley 64 through which rope 22 passes is secured to the cable loop 60 by means of a swivel joint 66.

Thus, if the sail is on the starboard side of the mast, the pulley 64 is pulled by the sail to the starboard side of the mast (as shown in FIG. 8); likewise, if the sail is located on the port side of the mast, the pulley can slew round on the cable 60 until it is located on the port side of the mast. With this arrangement, an even pressure is distributed by the wire loop 60 on the mast and furthermore, no twisting movement is exerted on the mast.

The sail of the boat shown in FIG. 1 is loose-footed, that is to say it has no boom attached to the foot of the sail. In an alternative embodiment shown in FIG. 4, a boom 68 is used. In this embodiment, the foot/luff corner 30 (or tack) of the sail is attached to one end of a wire 70 the other end of which is attached to the forward end of the boom 68 by means of a snatch-lock (not shown) engaging in an eye 71 in a further snatch-lock 72 secured at the forward end of the boom 68 by a bolt 92 (see FIG. 6). The further snatch-lock 72 is connected to the yoke 34 by means of a chain 56 and a snatch-lock 58.

In this embodiment, the U-shaped bolt is provided with a pair of horns 74 (see FIG. 7) and is mounted transversly across the boat, in distinction to the U-shaped bolt shown in FIG. 2 which is mounted longitudinally. The clew 38 of the sail is secured to the boom 68 by a rope 76 that passes through a pulley 78 fixed to the boom. The tension applied to the sail by rope 76 can be adjusted by pulling or releasing rope 76 and securing its end using cleat 80.

Referring again to FIG. 6, the mouth of the hook of the snatch-lock 72 is closed by a spring-loaded tongue 82. When it is desired to change the boat onto an opposite tack, the sail is lowered slightly, the snatch-lock 72 is released from the U-shaped bolt 46 by pressing the tongue 82 and the boom is pushed forward, the boom is then swung around the mast 16 in a manner analogous to that described in connection with FIGS. 1 to 3 above and when the boom is located on the other side of the mast 16, it can be resecured to the bolt 46 by means of snatch-lock 72. The boom is prevented from being blown about by the wind when it is released from the bolt 46 because it is attached to the yoke 34 by means of the chain 56 and snatch-lock 58.

Although the tongue 82 of the hook 72 can be pushed back manually to release the lock from the bolt 46, this could give rise to problems in heavy seas and in order to alleviate this problem, a wire 84 could be tied to the tongue, the wire passing through a bore 86 in the lock body and slidable secured to the boom by screw eyes 88; the end of the wire can be fitted with an eye 90 to assist in pulling the wire, thereby opening the mouth of the snatch-lock 72. As stated above, the bolt 46 is placed transversely at the bow of the boat and the arrangement of the bolt together with the yoke 34, the mast 16 and the boom 68 is shown in FIG. 5. It will be noticed that the yoke is not symmetrically arranged with respect to the bolt 46 but this does not affect the operation.

The main benefit of providing a boom is that the helmsman can look under the sail, otherwise it would be necessary to fit a window in the sail shown in FIG. 1 so that he could see where the boat was going.

When changing tack, (see FIGS. 4 and 5), the bowman would drop the sail slightly by loosening rope 22 and re-affixing it to cleat 24; he would then pull on wire 84 to retract tongue 82 and push boom 68 forward till snatch-lock 72 disengages from bolt 46; the boom 68, the forward end of which is quadrilateral in shape, is then moved around the mast, thus moving the sail to the other side of the mast and the forward end of the boom is swung forward and placed between the horns 74 of bolt 46 (see FIG. 7), the boom is then pulled back until tongue 82 of snatch-lock 72 engages bolt 46 thus resecuring snatch-lock 72 to bolt 46. The luff rope 26 is then made taut by hauling on rope 22 and securing the rope on cleat 24. In moving the boom to the other side of the mast, the snatch lock 58 with chain 56 will slide along yoke 34, thus preventing the foot of the sail from being blown away from the boat.

An alternative to the above arrangement is to use a steel rope in place of the yoke, so that the rope extends around the mast; in the case of such an arrangement, the boom 68 could then be secured to the wire by a simple swivel secured to the boom; such a swivel would take the place of the chain 56 and snatch lock 58.

I claim:

1. A sailing boat comprising:

a bow end, a stern, a mast, said boat having a single sail, said single sail hoistable on said mast to lie both forward and aft of said mast, said single sail being a main sail, said single main sail having a taut luff edge located forward of said mast, a foot edge at a bottom of said single sail and a corner between said foot edge and said luff edge, hereinafter referred to as a foot/luff corner, and means for releasably securing said foot/luff corner to said bow end of said boat in a position substantially forward of said mast, the arrangement being such that said single sail is located on a starboard side of said mast or on a port side of said mast and is movable between said starboard and port sides.

2. A sail boat is claimed claim 1, further comprising means connecting foot/luff corner of said single main sail to said boat even when said releasable securing means is released.

3. A sailing boat as claimed in claim 2, wherein said connecting means comprises a guide that extends around an aft section of said mast and a connector secured at a proximal end to said single main sail and at a distal end to said guide, said connector being slideable on said guide.

4. A sailing boat is claimed in claim 3, wherein said guide is a yoke secured to a deck at said bow end.

5. A sailing boat as claimed in claim 3, wherein said guide is a loop of rope or of wire.

6. A sailing boat as claimed in claim 1, further comprising a boom; and wherein said releasable securing means comprises means for securing said foot/luff corner to said boom and means for releasably securing said boom to said bow end of said boat forward of said mast.

7. A sailing boat as claimed in claim 6, further comprising means for connecting said boom to said boat even when said releasable securing means is released.

8. A sailing boat as claimed in claim 1, wherein a loop is secured to a top of said mast, wherein a pulley is slideable on said loop and wherein said single main sail is raised and lowered by means of a rope passing through said pulley and secured at one end to said single main sail.

* * * * *